US005839650A

United States Patent [19]

Sheffer

[11] Patent Number: 5,839,650

[45] Date of Patent: Nov. 24, 1998

[54] STACKABLE CONTAINER

[75] Inventor: Phil B. Sheffer, Thomasville, Pa.

[73] Assignee: Triangle Container Corporation, Philadelphia, Pa.

[21] Appl. No.: 814,731

[22] Filed: Mar. 7, 1997

[51] Int. Cl.[6] ..... B65D 25/04

[52] U.S. Cl. ..... 229/120.11; 229/919; 229/117.16

[58] Field of Search ..... 229/120.11, 120.18, 229/915, 919, 117.09, 117.16, 117.17

[56] References Cited

U.S. PATENT DOCUMENTS

| | | | |
|---|---|---|---|
| 2,893,621 | 7/1959 | Harnish et al. | 229/915 X |
| 3,102,674 | 9/1963 | Hamilton . | |
| 3,157,346 | 11/1964 | Hamilton | 229/915 X |
| 3,734,392 | 5/1973 | Clark | 229/117.16 X |
| 3,756,499 | 9/1973 | Giebel et al. | 229/919 X |
| 3,929,273 | 12/1975 | Swanson | 229/918 X |
| 3,940,053 | 2/1976 | Putman et al. | 229/915 X |
| 4,058,249 | 11/1977 | Buck | 229/915 X |
| 4,101,048 | 7/1978 | Rieben et al. | 229/117.16 X |
| 4,165,031 | 8/1979 | Osborne | 229/919 X |
| 4,347,969 | 9/1982 | Kost et al. | 229/915 X |
| 4,356,952 | 11/1982 | Rekow . | |
| 4,770,339 | 9/1988 | Weimer | 229/918 X |
| 5,413,276 | 5/1995 | Sheffer | 229/120.11 |
| 5,458,283 | 10/1995 | Southwell et al. | 229/918 X |
| 5,524,815 | 6/1996 | Sheffer | 229/120.18 |

*Primary Examiner*—Gary E. Elkins
*Assistant Examiner*—Tri M. Mai
*Attorney, Agent, or Firm*—Eckert Seamans Cherin & Mellott, LLC

[57] ABSTRACT

A container formed from an integral piece of corrugated material includes projections extending from its upper side edges, and notches disposed on its lower side edges. The projections of one container are placed and sized to engage the notches of a similar container so that the containers engage when stacked. The engagement of the sides is such that the containers are unlikely to be inadvertently horizontally displaced, and have increased vertical weight bearing strength. The containers are apt for shipping and display cartons stacked on pallets accessed directly by end-user customers. The containers have four-layer sides to further bear vertical forces, to resist inadvertent collapse of the container or a stack of containers, and to increase horizontal rigidity.

17 Claims, 5 Drawing Sheets

STACKABLE CONTAINER

BACKGROUND OF THE INVENTION

1. Field of the Invention

The invention relates to a packing/shipping/display container formed from an integral flat piece of sheet material, the container having vertical load bearing and positioning structures that are advantageous for container stacking and the shipping and marketing of products on pallets and in stacks.

2. Background

Cartons or containers formed from folded corrugated paperboard or similar flat sheet stock material are often stacked on one another during shipping and storage of products. In high volume retail stores, product is not only stored in stacked cartons, but frequently is presented to consumers in that form, e.g., with the stacked cartons disposed on pallets. Stacking is obviously efficient as to the use of space and pallets enable a number of cartons to be handled as a unit. The uppermost remaining carton on a pallet is accessible to consumers for obtaining the product. When empty the carton is removed and the next lower carton becomes accessible.

Each pallet generally contains multiple horizontal layers of boxes, with each layer consisting of multiple boxes arranged adjacent to one another. Sometimes boxes are oriented such that upper boxes overlap two or more boxes in a next lower layer. However, this is not always possible or advisable, for example when the boxes have open tops to permit access to the product in the boxes. In such cases the boxes may be stacked in registry with one directly over another, effectively creating multiple "towers" of adjacent stacked boxes that laterally abut one another but are not structurally engaged.

Containers in stacks are subjected to various forces, not limited to vertical compression due to the weight of containers over them in a stack. Such forces (as well as vertical compressive forces) are aggravated by handling, for example transport of a stack on a pallet, manual handling of one or more containers in a stack, etc. Tension and/or compression applied in various directions to the container walls can be sufficient to wholly or partly collapse a container or laterally to deflect, bend or fold the vertically oriented walls of the container. The result is a reduction of structural integrity, and may include crushing or other damage to the container contents. In addition, when the walls of one or more containers in a stack are crushed, wholly or partly collapsed, or otherwise deformed, the deformed container may no longer provide a stable horizontal support for containers stacked over it. The overlying stack may then tip laterally. A leaning "tower" of containers may fall, and even if there is no injury to persons, the contents of the containers may spill or be damaged.

Pallets and similar arrangements of multiple stacked containers are popular means for presenting products to consumers in so-called "warehouse" stores, wholesale clubs, and other facilities which have versatile open floor space and need to move a substantial quantity of product. In such situations, pallet storage is preferable because substantially less work, attention and expense is required than in stocking shelves. The pallet or other supporting arrangement of multiple stacked containers from the shipper is simply moved onto the floor of the warehouse or other sales establishment without rearrangement or modification to the stacks of containers. External strapping is removed, and the top-most containers can be opened so that the items can be seen and selected by customers for purchase. As containers are emptied, they are generally flattened for recycling, and the next underlying containers are opened until the pallet of containers eventually is emptied, removed and replaced.

A shipping and retail display carton having means for improving access to the product in the container is disclosed in U.S. Pat. No. 5,413,276—Sheffer, which is hereby incorporated. The carton is cut, glued and folded from a flat blank. Sidewall openings are provided such that the customer can reach into the carton from the front or from the top when the carton is opened. The sidewall openings are covered by flaps attached to top panels of the carton such that the openings are uncovered when the top is removed. Two sidewall openings are provided in the same front sidewall, leaving a web of the sidewall between them, which is supported by an internal wall spanning from the back wall to the web at the front wall, to which the internal wall is attached. This carton is apt for pallet displays and the like because it provides protection and support during shipping and access to the product when opened. However once opened, the carton is prone to collapse due to a lack of structural support caused by the sidewall openings.

Use of pallets of shipping/display containers for storage and display of product at the customer level heightens problems with total or partial collapse of the containers or stacks of containers. For example, in addition to handling by retail/warehouse personnel typically associated with pallets of containers, multiple potential customers have access to and perhaps manipulate stacked containers. Crushed or damaged containers, and merchandise in the containers, are immediately visible to potential customers, reducing the appeal of the product and potentially damaging the reputation of the warehouse retailer or other seller. Falling "towers" of containers and spilled product may disrupt traffic flow, startle customers or cause injuries by virtue of impact or consequential slip and fall incidents.

Apart from instability due to partial collapse of the walls of one or more containers in a stack, instability leading to spills and possible collapse of a stack may be caused by containers being shifted horizontally relative to underlying containers. Customer access and traffic in retail/warehouse stores makes it likely that containers will be shifted horizontally.

It often is necessary for stock clerks at the warehouse retailer to rearrange containers on a pallet as certain containers are emptied, for example to consolidate product from a number of nearly empty open cartons into one, to restack or reposition the cartons for neatness, etc. It is advantageous if such rearrangement can be accomplished easily and quickly, especially because stock clerk staffing at warehouse retailers is preferably minimal. Containers stacked on a pallet, however, may be difficult to maneuver easily or quickly, may be stacked in close proximity to each other and may be bulky and cumbersome when filled with merchandise. If containers are stacked on open containers, which is sometimes desirable, the stack may have inadequate support.

Preferably, the retailer rather than the customer is the party who opens the cartons, often using a knife to slice through tape or cardboard. Removing carton tops takes time and generates waste material which must be efficiently removed from the display floor. Many simple carton arrangements have a so-called HSC top cover, taped to an open-top box, which cover must be removed to expose the contents of the container. Such a top cover is basically a second inverted box that fits over the open top of the carton. Other containers typically stacked on pallets or the like may have tops which, when opened, become unrestrained flaps which interfere with potential customers' access to the contents inside, or which must be removed from the display area.

It is possible to reinforce a carton against vertical loads by adding internal walls as in the above '276 patent to Sheffer. In addition, the thickness of the vertical walls can be increased. For example, the central vertical wall extending between the back wall and the web between the access openings in the '276 patent can be reinforced against vertical compression by using multiple layers of material.

Typically, flaps are provided on the original blank to extend from the top edges of the sidewalls, and are folded into the box in order to double the thickness of the sidewalls. Provision must be made to hold the flaps down, such as gluing or locking tabs, for example as in U.S. Pat. No. 5,524,815, also hereby incorporated, wherein a multiple thickness internal wall is locked to a structure extending upwardly on the bottom of the box. These arrangements can be complicated. Additional flaps enlarge the size of the cut blank. And, increasing the thickness of the vertical walls may not prevent crushing or deformation of the carton, particularly a carton having access openings as in the '427 and '815 patents. The web between the access openings and the sidewall portions surrounding the access openings, are especially susceptible to vertical crushing, lateral deformation by bending or folding and other damage that can partly collapse a carton or a stack. In addition, such containers do not inhibit horizontal displacement from the stacked relationship, and in fact horizontal displacement may aggravate deformation of the sidewall having the access openings.

There is a need for a container with improved strength characteristics to withstand the collapsing or lateral deflection of vertical container walls which may result when forces are applied to such containers.

The is further a need for a container that is optimally adapted for pallet-type marketing, namely retail sale of products displayed in bulk in the containers in which they are shipped in bulk.

There is also a need for a container which resists inadvertent, horizontal displacement out of stacked relationship.

There is a further need for a container which is easy to manipulate and easy to open to display the contents thereof.

There is also a need for the container to have sufficient lateral rigidity to avoid collapse.

Advantageously, these objects and aspects should be achieved in a carton that is foldably erected from a one piece blank that is compactly arranged such that the carton blanks can be die cut from stock with minimal waste.

SUMMARY OF THE INVENTION

It is an object of the invention to provide a container with improved vertical strength and lateral rigidity, and which otherwise overcomes the drawbacks and disadvantages of the prior art.

These and other aspects and objects are provided according to the invention in a container with a bottom, front, back and opposing sides. The sides each comprise at least four side panels in substantially registered relationship with each other. At least one of the sides has a projection extending from one of two horizontal edges and the other horizontal edge has a structure for receiving a projection therein. According to one aspect of the invention, the above-described container is capable of being stacked with a second container having opposing sidewalls as described, so that when the two containers are stacked in alignment with each other, the projection and the structure for engaging the projection of one of the containers engages the complementary structure of one of the side walls of the other container. Thus the cartons lock together vertically for aligning stacks of the containers and for substantially concentrating any vertical compression forces in the sidewalls.

According to another aspect of the invention, the four side panels include a pair of inner panels and a pair of outer, surrounding panels with the projection and the structure for engaging the projection each being located on one of the inner panels on each of the sides.

According to still another aspect of the invention, each of the sides has a pair of the projections and a pair of the structures for engaging the projections, and the projections have a double wall thickness by virtue of being formed from overlying portions of the two inner panels. Likewise, the structure for engaging the projections is a notch having a double wall thickness by virtue of being defined by edges of the two inner panels in registered relationship with each other.

The panels of the container, according to yet another aspect of the invention, are formed from an integral blank of corrugated board. The blank is a compact form in which the various panels are joined at folds or perforations but substantially occupy a rectilinear area, thereby minimizing waste. The blank of corrugated board includes panels which form a partition extending across the contained space of the container, thereby forming multiple compartments. The partition substantially spans the height of the contained space.

According to yet another aspect of the invention, the four side panels comprise an interior panel and three panels exterior to the interior panel. The three exterior panels have openings defined therein which are in substantial registration with each other, thereby defining handholds in the sides of the container. The interior panel has a portion aligned with the handhold openings to prevent access to the contained space through the handholds.

A blank for a corrugated carton according to the present invention has front and back panels corresponding to the front and back of the carton. Side panels are foldably attached to the front and back panels at the side edges of the front and back panels. The side panels correspond to the exterior sidewalls of the carton and have first and second transverse edges extending between the front and back panels. A reinforcing panel is foldably connected to the first transverse edge of each of the side panels. The reinforcing panel includes a base layer and at least one overlying layer. The overlying layer has third and fourth transverse edges which are spaced from and substantially parallel to one of the transverse edges of the side panels. At least one projection extends from the third transverse edge of the overlying layer and at least one notch is formed in the fourth transverse edge thereof. The base layer has a web portion which bridges the space between the third transverse edge of the overlying layer and the first transverse edge of the reinforcing panel. An aperture is defined in the web portion and is located proximate to the projection extending from the third transverse edge of the overlying layer. In this way, when the carton is erected and the reinforcing panel folded adjacent to the side panel, the projection is received through the aperture, the third transverse edge is in substantial alignment with the first transverse edge, and the projection extends beyond the substantially aligned first and third transverse edges.

The blank, in another aspect of the invention, may include a pair of the overlying layers on each side panel. The side panels and the overlying layers each have openings located to be in registration with each other when the carton is erected to form handholds of triple wall thickness.

BRIEF DESCRIPTION OF THE DRAWINGS

There are shown in the drawings a certain exemplary embodiment of the invention as presently preferred. It should be understood that the invention is not limited to the embodiment disclosed, and is capable of variation within the scope of the appended claims. In the drawings.

DETAILED DESCRIPTION OF THE PREFERRED EMBODIMENT

Figure 1:
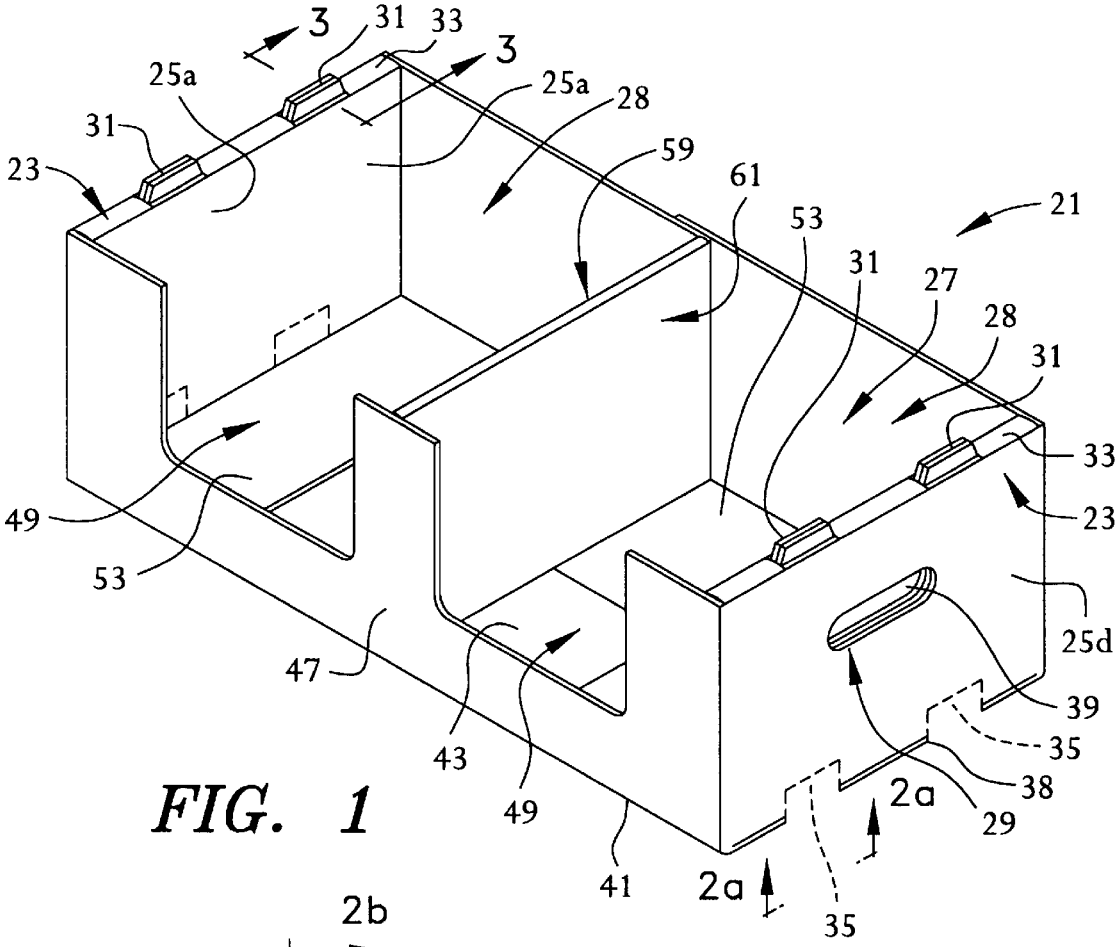
FIG. 1 is a perspective view of a two-compartment, stackable container according to the present invention, shown deployed and ready to be loaded with product.
Figure 2:
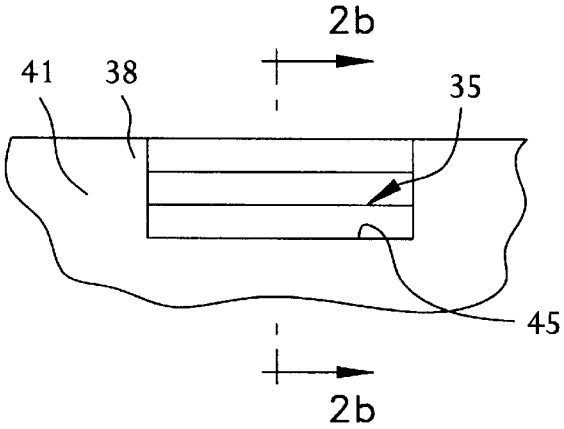
FIG. 2*a* is a partial, bottom plan view taken along line 2*a*—2*a* of FIG. 1 and showing one of the notches in the carton of the present invention.
FIG. 2*b* is a partial, side elevational view taken along line 2*b*—2*b* of FIG. 2*a* and showing further details of the notch of FIG. 2*a*.
Figure 3:
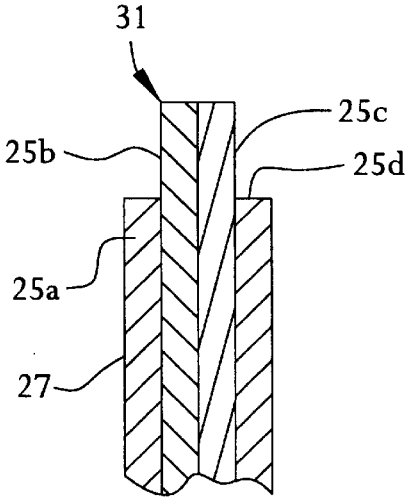
FIG. 3 is a partial, side elevational view taken along line 3—3 of FIG. 1 and showing one of the projections of the carton of the present invention.

FIGS. 1–3 show a stackable container 21 according to the present invention in its erected or deployed state and ready to be loaded with product. The strength of container 21, including its resistance to deformation from vertical compression or lateral deflection, is enhanced by having opposite sides 23 formed as a multi-layer structure of four adjacent side panels 25*a*–25*d* (FIG. 3). Side panels 25*a* are adjacent to contained space 27 of container 21 when deployed. Side panels 25*b*, 25*c* and 25*d* are adjacent and exterior to interior panels 25*a*.

Figure 2B:
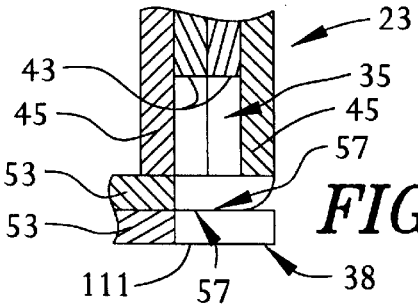

Side panels 25*a*–*d* are formed as discussed in detail below so that a pair of projections 31 extend outwardly from upper horizontal edge 33 of each of sides 23. Referring to FIGS. 1, 2*a*, and 2*b*, means for engaging projections 31, here shown as a pair of notches 35, are formed at lower horizontal edges 38 of container 21. The notches 35 extend from container bottom 41 into sides 23.

Figure 4:
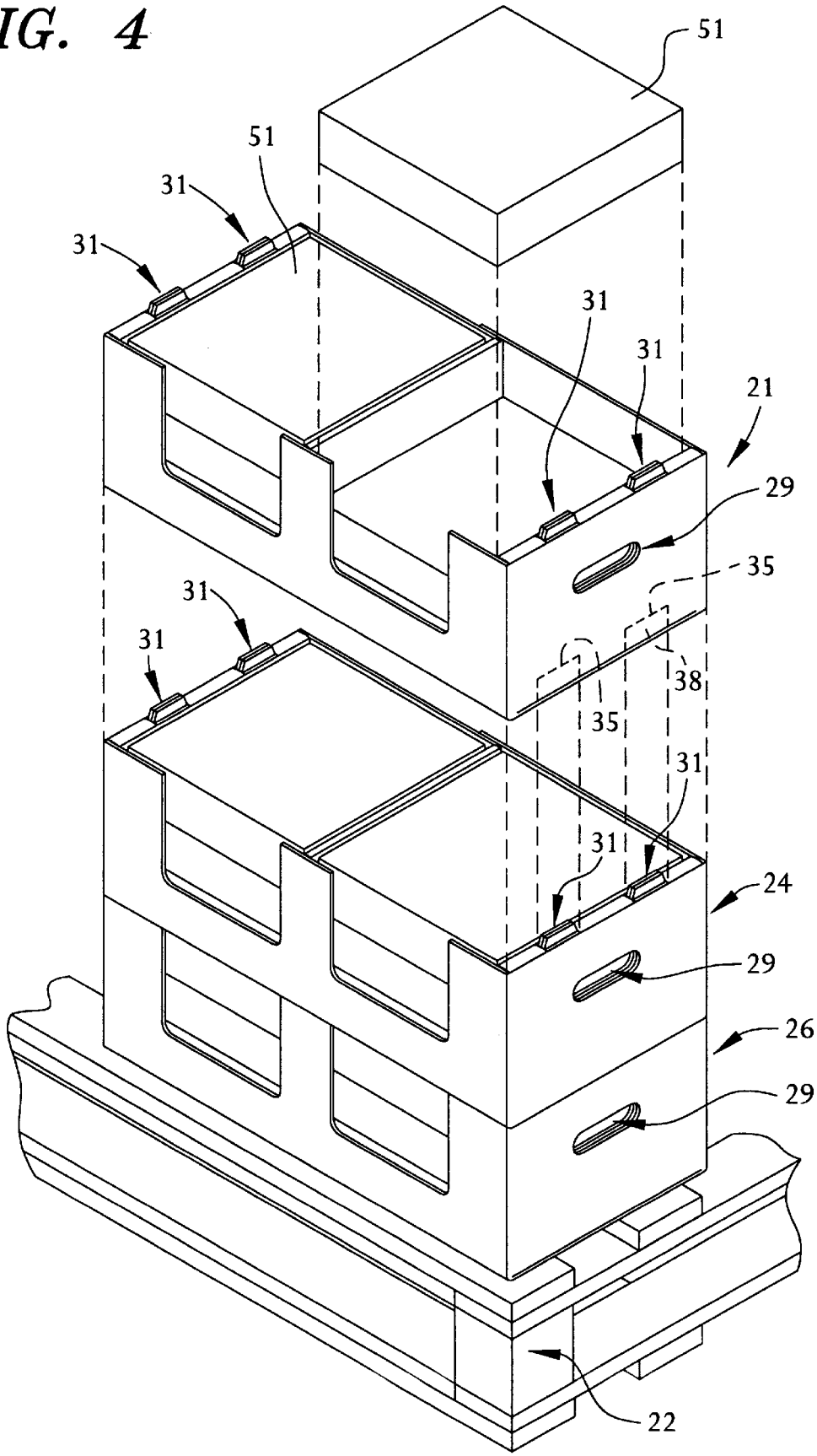
FIG. 4 is a perspective view of multiple containers according to the present invention stacked on a pallet in registration with each other and loaded with product.

As seen in FIG. 4, notches 35 are located along lower horizontal edges 38 of container 21 so that they receive corresponding projections 31 extending outwardly from upper horizontal edges 33 of a second, underlying container 24 which is substantially identical to container 21, stacked thereon. In this embodiment, underlying container 24 has projections 31 extending upwardly when on pallet 22, whereas overlying container 21 has notches 35 opening downwardly to engage the upwardly oriented projections 31 of underlying container 24. Although FIG. 4 shows three stacked containers 21, 24, 26, the interengagement of corresponding projections 31 and notches 35 keeps any practicable number of stacked containers in substantial registration with each other, and thus resists inadvertent horizontal displacement which might cause the containers to fall from pallet 22 either singularly or as a collapsing "tower."

Moreover, the arrangement of projections 31 and notches 35 cause the side walls of the containers to bear on one another, substantially confining vertical compression forces to the side walls, which are reinforced and made quite strong by the superimposition of multiple layers of material, namely side panels 25*a*–25*d*. The side walls of the containers in a stack, as locked together by projections 31 and notches 35, thus form two vertical columns that more readily bear the weight of additional containers added to the stack than would, for example, the front and rear walls.

The structure of side panels 25*a*–*d* is seen with reference to FIGS. 1–3 and 5. Side panels 25*b* and 25*c* constitute inner panels in that they are inside each of the sides 23 and are adjacent to each other. On either side of inner panels 25*b* and 25*c* are outer panels 25*a* and 25*d*. Outer panel 25*a* is adjacent to inner panel 25*b*, whereas outer panel 25*d* is adjacent to inner panel 25*c*. Projections 31 are located on at least one of the inner panels 25*b* or 25*c* on each of sides 23. In this embodiment, projections 31 are formed by portions of both inner panels 25*b* and 25*c* which are in registered relationship with each other, which extend co-extensively from sides 23, and which therefore give projections 31 a double-wall thickness (FIG. 3).

Notches 35, of which one is shown in FIGS. 2*a* and 2*b*, are also formed in at least one of the inner panels 25*b* and 25*c* at lower horizontal edges 38 of opposite sides 23. In this embodiment, notches 35 are formed in both inner panels 25*b* and 25*c* by cut-away portions 43 which are in substantial registration with each other, which extend co-extensively into sides 23 from lower horizontal edges 38, and therefore provide each notch 35 with a double-wall thickness. Notches 35 are further defined by longitudinally extending sidewall portions 45 of outer panels 25*a* and 25*d*. Notches 35 are sized to receive projections 31 therein.

Although projections 31 may assume a variety of shapes, one preferred shape is generally rectangular, advantageously with a slight taper. The tabs are elongated so as to extend a greater distance along horizontal edges 33 than they extend outwardly therefrom. The tabs and the notches are preferably closely complementary, although the tabs can be tapered while the notches are substantially rectangular, having a width equal to that of the base of the tabs.

Figure 5:
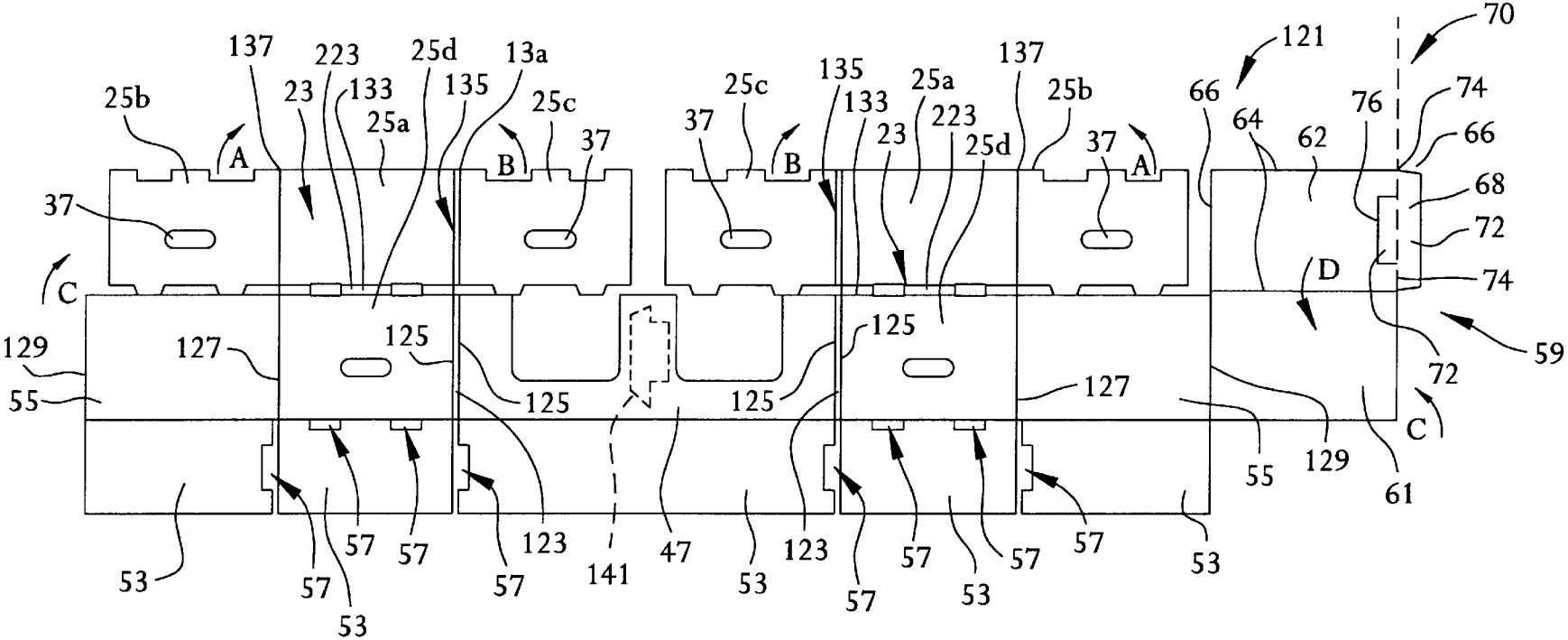
FIG. 5 is a top plan view of a die-cut, corrugated sheet used in forming the carton of FIGS. 1–4.

FIG. 5 shows a blank 121 of corrugated sheet material from which container 21 is made. The blank can be die cut from a larger sheet, and due to the substantially rectangular and compact form of the die cut blank 121, waste of material is minimized. As seen in FIG. 5, side panels 25*b*, 25*c* and 25*d* each have openings 37 therein. These openings are positioned so that, when container 21 is erected as shown in FIG. 1, openings 37 are in substantial registration with each other to define handholds 29 in sides 23 of container 21 (FIG. 1). Interior panels 25*a* on each of sides 23 have a solid portions 39 (FIG. 1) in registration with openings 37 in exterior panels 25*b*–*d*. The solid portions 39 thereby prevent access through handholds 29 to contained space 27. Container 21 thus may be easily picked up or otherwise manipulated by inserting fingers into handholds 29 without fear of damaging contents held in contained space 27.

The handholds confine forces on the container when carried to the side walls in the same manner that the multiple thickness interlocking side walls of containers in a standing stack form supporting columns. Two or more containers can be readily carried by the handholds with the sidewalls locking the containers together and bearing the load with substantial support from the sidewalls of the coupled containers.

On each side 23, the side panels 25*a*–25*d* each extend substantially between corresponding upper horizontal edge 33 and lower horizontal edge 38. In this way, each of the panels 25*a*–*d* acts to increase the compressive strength of sides 23. The side panels 25*a*–25*d* in this embodiment have opposing surfaces which are in substantial contact with each other, thereby forming a multi-layer, sandwich-like structure which is resistant to lateral deflection, in part because the opposing surfaces of panels 25*a*–25*d* bear against each other when exposed to a lateral deflecting force.

Referring to FIGS. 1 and 4, container 21 has a front 47 with cutaways 49 defined therein. As best seen in FIG. 4, cutaways 49 facilitate access to product packages 51, especially if multiple product packages 51 are stacked within container 21 one on top of another. Under such circumstances, access to lower layers of the stacks of product packages 51 is facilitated because cutaways 49 allow access to portions of such packages through front 47 of container 21 rather than needing to access such layers through the top of container 21.

As seen in FIGS. 1 and 5, bottom 41 of container 21 comprises multiple bottom flaps 53. Bottom flaps 53 are foldably connected to sides 23, front 47, and back 55 of container 21 in any suitable manner to span contained space 27 of container 21. Bottom flaps 53 may at least partially overly one another in a manner known in the art to provide suitable strength to bottom 41 of container 21.

Bottom panels or flaps 53 have formed therein bottom cutouts or notches 57 shown in FIGS. 2*b* and 5. Bottom notches 57 are selectively placed along edges of certain ones of bottom flaps 53 so that, when the carton 21 is erected, bottom notches 57 are in substantial registration with corresponding notches 53 at the lower edges 38 of sides 23. In this way, and as best seen in FIG. 2*b*, bottom notches 57 define a portion of notches 35 and allow corresponding projections 31 to engage notches 35 from the bottom 41 of the container 21. Bottom flaps 53 of an overlying container thus do not interfere with interengagement of notches 35 with corresponding projections 31 of an underlying container (FIG. 4).

As seen in FIGS. 1 and 4, contained space 27 is divided into two compartments 28 by vertically oriented partitioned 59. Partition 59 substantially, vertically spans the height of contained space 27 and thereby strengthens the compressive strength of container 21. Partition 59 preferably comprises a pair of partition panels 61, which are preferably foldably connected to each other and whose opposing surfaces are in substantial contact with each other for form a two layer partition 59.

Container 21 is preferably formed from a single sheet of corrugated paperboard stock suitably die-cut and perforated to form multiple, foldably connected panels, such as shown in the blank 121 in FIG. 5. Blank 121 is a sheet of material comprising a plurality of panels foldably attached to one another, and the panels have been identified with reference numerals corresponding to the elements of the erected container 21 shown in FIGS. 1–4. Side panels 25*d* are attached to front panel 47 at opposite edges 123 of front panel 47. Opposite edges 123 each comprise a pair of vertically extending fold lines 125 which are slightly, laterally spaced from each other to accommodate the multi-layer thickness of what will become sides 23 of container 21. Panels corresponding to back 55 of container 21 are foldably connected at each outer edge 127 of side panels 25*d*. Bottom flaps 53 are foldably connected to lower edges 131 of panels 47, 25*d*, and 55.

Partition 59 comprises two partition panels 61, 62, which are foldably connected to one of the outer edges 129 of back 55. Partition panel 62 has opposite, transverse edges 66 and opposite longitudinal edges 64 extending therebetween. Panel 62 is connected to partition panel 61 along one of its longitudinal edges 64. A partition flap 68 is defined integrally with panel 62 at one of the transverse edges 64. The flap 68 is foldable along an axis indicated by 70 which is substantially parrallel to the transverse edges 64. Flap 68 has two tab sections 72 extending in relatively opposite directions from axis 70. When flap 68 is folded about axis 70, the tabs 72 extend outwardly from a plane coincident with panel 62.

Flap 68 is defined by a pair of fold lines 74 coincident with axis 70, each extending inwardly from a corresponding one of the longitudinal edges 64 and terminating in a cut 76. Cut 76 extends inwardly from axis 70. The two-wall thickness of partition 59 is formed by folding panel 62 in the direction indicated by the arrow D so that it overlies panel 61. When thus folded, the partition panel 62 and its coplanar partition flap 68 comprise the upper of the two layers as shown in FIG. 5.

Side panels 25*a*–*d* are arranged adjacent each other in two "T" configurations which will form the two opposite sides 23 when container 21 is in the deployed state shown in FIG. 1. Side panels 25*d* have upper transverse edges 133 to which side panels 25*a* are foldably attached. Side panels 25*a*, in turn, have inner vertical edges 135 to which side panels 25*c* are foldably connected. Side panels 25*a* have outer vertical edges 137 opposite inner vertical edges 135. Side panels 25*b* are foldably connected to outer vertical edges 137.

Figure 6:
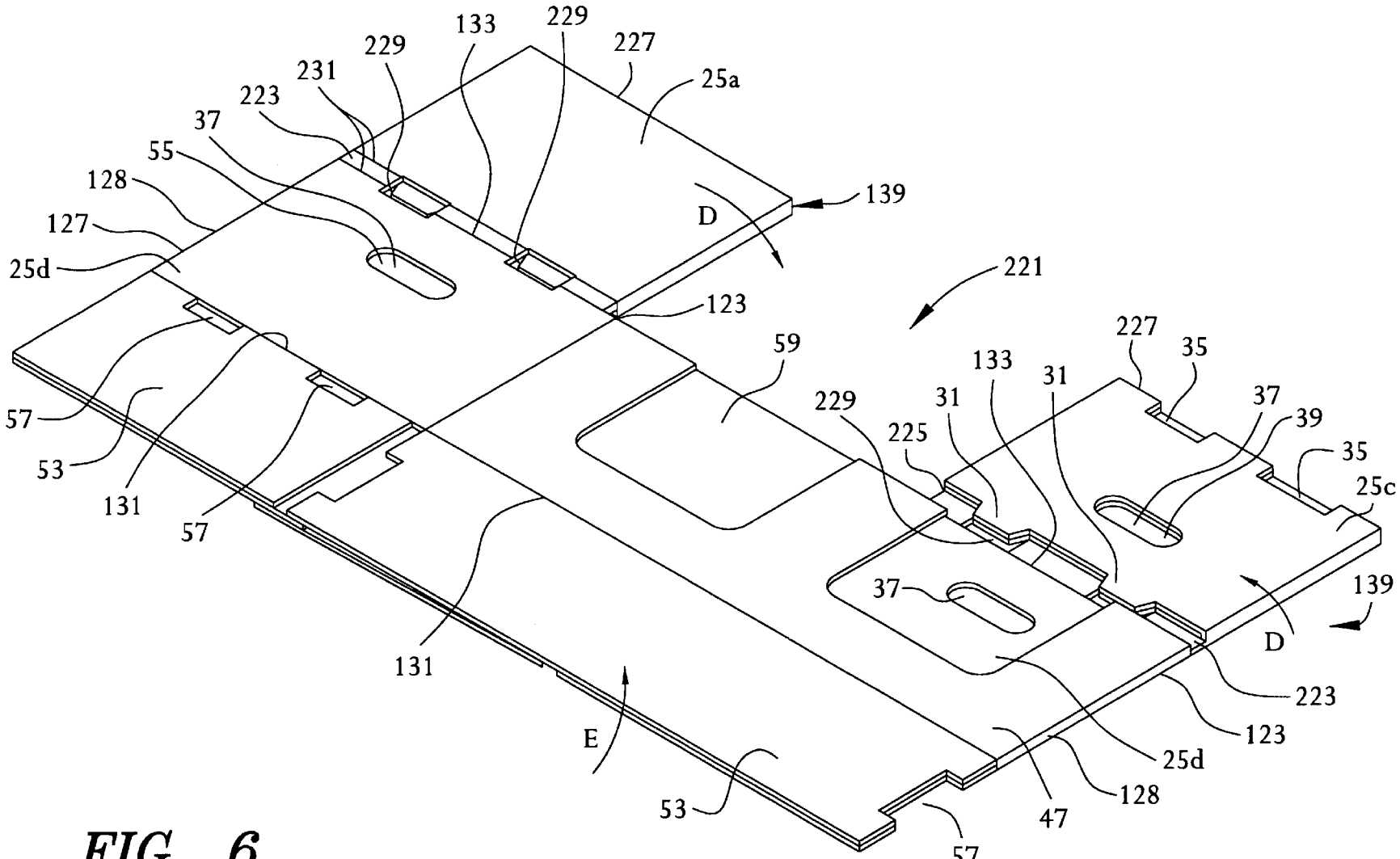
FIG. 6 is a blank according to the present invention formed from the die-cut sheet of FIG. 5.

A corrugated sheet or blank 121, as die-cut and perforated as shown in FIG. 5, may be suitably folded and glued to form a blank 221, shown in FIG. 6, using a fold-and-glue machine through which blanks are fed. Blank 221, also known as a shipper's blank, is in the collapsed form generally sent by the container manufacturer to its customers for their use in packing products for shipment to end-user locations. To form blank 221, side panels 25*b* are folded along outer vertical edges 137 in the direction indicated by arrows A to overlie side panels 25*a*. Then side panels 25*c* are folded along inner vertical edges 135 in the direction indicated by arrows B to overly side panels 25*b*. Inner vertical edges 135 (FIG. 5) comprise a pair of slightly, laterally spaced fold lines 139 to account for the thickness of side panel 25*b*. One or more of side panels 25*a*–25*c* are provide with a suitable pattern of adhesive to form three-layer, reinforcing panels 139 (FIG. 6).

The die-cut and perforated blank 121 (FIG. 5) is folded generally in the direction indicated by the arrows C. Partition flap 68 is adhered to zone 141. Although the folding of side panels 25*a*–*d* and partition panels 61, 62 described above has created various multi-layer structures, partition flap 68 is readily adherable to zone 141 because partition panel 62 directly opposes front panel 47 without intermediate panel layers inhibiting good contact therebetween. When flap 68 is adhered in this manner, tabs 72 are secured and become positioned to either side of partition 59 when the container is erected as shown in FIG. 1. At a suitable point during the folding of blank 121, outer edges 129 are generally adhered to each other to form back 55.

The erection of blank 221 can be appreciated with reference to FIG. 6, in which the blank 221 is shown with the front side 47 of container 21 facing upwardly. (Structures corresponding to those found in the blank 121 of sheet material have been given like reference numerals as they appear in blank 221.) When the blank lies flat as shown in FIG. 6, side panels 25*d* are foldably attached to outer side edges 123 of front 47. Back 55 of container 21 remains foldably connected to outer edges 127, one of which is shown in FIG. 6 (both of which are seen in FIG. 5). Side panels 25*d* correspond to the exterior sidewalls of carton 21 when it is deployed.

Reinforcing panels 139 are foldably connected to corresponding upper, transverse edges 133 of side panels 25*d*. Each of the reinforcing panels 139 comprises three layers: a base layer corresponding to side panel 25*a* and two, overlying layers corresponding to side panels 25*b* and 25*c*. When blank 221 is lying flat as shown in FIG. 6, one of the reinforcing panels 139 (on the left of FIG. 6) is facing downward so as to reveal its base layer corresponding to side panel 25*a*, whereas the other reinforcing panel 139 is facing upward, thereby revealing the uppermost, overlying layer corresponding to side panel 25*c*.

Overlying side panels 25*b* and 25*c* each have a pair of transverse edges 225 and 227, which are substantially parallel to each other and to corresponding transverse edges 133 of side panels 25*d*. Transverse edges 225 are laterally closer to transverse edges 133 than are transverse edges 227. A pair of transversely spaced notches 35 is formed in each of the transverse edges 227, and a pair of transversely spaced projections 31 extends from transverse edges 225.

Notches 35 and projections 31 are located on transverse edges 227, 225, respectively, so that, when side panels 25*b* and 25*c* are folded over side panels 25*a* to form reinforcing panels 139, the notches 35 and projections 31 of adjacent, overlying panels 25*b* and 25*c* are in registration with each other and thereby form projections 31 and notches 35 of double-wall thickness. Similarly, side panels 25*b* and 25*c* each have openings 37 defined therein so that, upon folding to form reinforcing panels 139, a handhold 29 of double wall thickness is preliminarily formed on reinforcing panel 139.

Side panels 25*a*, which comprise the base layer of reinforcing panels 139, each have a web portion 223 which extends from corresponding transverse edge 133 to transverse edges 225 of overlying, side panels 25*b* and 25*c*. Thus, transverse edges 225 and 133 are substantially parallel to each other and laterally spaced from each other by a distance equal to the width of web portions 223. The edges of web portions 223 include fold lines 231 generally aligned with transverse edges 225 of overlying panels 25*b* and 25*c*.

Web portions 223 each have a pair of apertures 229 defined therein, which are positioned in alignment with and proximate to projections 31. Apertures 229 extend between opposing transverse edges 225, 133 and have a length substantially equal to or slightly exceeding the length of the tabbed-shaped projections 31.

When blank 221 shown in FIG. 6 is deployed or erected, the portion of the blank 221 which includes the front 47 is raised from back 55, such as in the upward direction indicated by the arrow E, thereby separating sides 23 from their overlying relationship with front 47 or back 55 and beginning to define the contained space 27 shown in FIG. 1. This is generally accomplished by exerting an inward force on the two outermost edges 128, which becomes a diagonal force erecting the blank from a parallelogram shape into a rectangular shape in plan view. Reinforcing panels 139 are folded generally inwardly along fold lines 231 in the direction of the nascent contained space 27 (FIG. 1), such as indicated by the arrows D (FIG. 6) until they are adjacent to, and in registration with, side panels 25*d* at respective opposite sides 23 of container 21. Bottom flaps 53 are suitably folded to create bottom 41 of container 21 (FIG. 1).

When the carton is erected as described, web portions 223, apertures 229, and projections 31 have been sized so that projections 31 are received in apertures 229. Web portion 223 has a width so that, when the carton is erected and reinforcing panels 139 are folded adjacent to side panels 25*d*, transverse edges 225 are in substantial alignment with transverse edges 133 and thereby form upper, horizontal edges 33 shown in FIG. 1 with double wall thickness projections 31 extending beyond edges 33. Side panels 25*b* and c have their transverse edges 227 located so that transverse edges 227 abut bottom 41 of carton 21, thereby providing a reinforcing function to sides 23 of container 21. Openings 37 in reinforcing panels 139 are in registration with corresponding openings 37 in side panels 25*d*, so that, when the reinforcing panels 139 have been folded into place at sides 23 of container 21, the handholds 29 have a triple-wall thickness defined by the three openings 37 of panels 25*b*–25*d* in registration with each other. Since side panels 25*a* do not have openings 37 therein, portions of such side panels 25*a* span the handholds 29 to close off access to contained space 27 through handholds 29.

As best seen in FIGS. 5, 6, and 2*b*, notches 35 in reinforcing panels 139 become aligned with bottom notches 57 in bottom flaps 53 so that notches 35 of container 21 may be engaged through its bottom 41 by projections 31 extending from the top of a second, underlying container 24 (FIG. 4).

In use, container 21 may be filled with product 51 and stacked with one or more other containers, such as containers 24 and 29 shown in FIG. 4. Each of the containers 21, 24, and 29 has a similar "footprint" or configuration in plan, and each of the containers has projections 31 and notches 35 located so that, when the containers are stacked in registration with each other, projections and corresponding notches of adjacent containers on the stack interengage. It is also possible to place the projections and notches so that alternating layers of containers can lap over one with an upper container engaging one projection from each of two adjacent containers on the next lower level. This feature can be used in particular for making pyramid shaped stacks as opposed to tower stacks where the containers on each level are strictly in registry.

In one possible application, a selected number of containers 21, 24, 29 filled with product 51 are stacked on pallet 22, and pallet 22 may be moved from receiving directly to the display floor of the retailer (perhaps after removing an external common cover, strapping or wrap), where end-user purchasers have access to the pallet of containers. The individual containers 21, 24, 29 do not include covers, tops or lids of corrugated material, instead being arranged such that the upper containers engage over and cover the next lower one. The containers are accessed on the display floor and generate less waste. Purchasers may select product 51 from one of the open containers, generally from those containers at the top of the stack. The increased strength of the containers allows the containers to better resist vertical collapse or lateral deflection caused by the forces of handling and the like. Handholds 39 allow containers to be easily manipulated by stock personnel or others, individually or in stacks of two or more. The containers' interengagement keeps the containers from being inadvertently horizontally knocked off the pallet or off of the stacks of containers.

The present invention may be formed from cardboard or other corrugated material with any of a variety of thicknesses and strength characteristics. Paperboard is also suitable. A preferred stock is standard corrugated craft, in a weight chosen to reflect the weight of the contents intended for the container.

Alternative embodiments may, of course, vary the dimensions of the resulting container 21 to fit any particular application. Likewise, partition 59, while it helps give compressive strength and lateral rigidity to container 21, is optional and may be dispensed with altogether in certain applications. On the other hand, additional reinforcing partitions similar to that of partition 59 may also be provided.

The side panels 25*a*–25*d* at each of the opposite sides 23, and the two-wall thick partition 59 create ten vertical walls to strengthen container 21. As a further alternative embodiment, each of sides 23 may include only three side panels, such as if one of the inner panels 25*b* or 25*c* were removed. In such alternative embodiment, there would be a total of eight vertical walls providing compressive strength to container 21.

As another alternative, the container of the invention may also include a top or other means to cover the container.

The number, location, and configuration of projections 31, notches 35 and handholds 39 may also be varied depending on particular applications and use conditions. For example, to give the container greater compression strength, the handholds 29 are preferably eliminated from the container. Such an arrangement leaves side panels 25*a*–*d* (as well as the resulting sides 23) without apertures therein which would otherwise diminish their resistance to compression.

Figure 7:
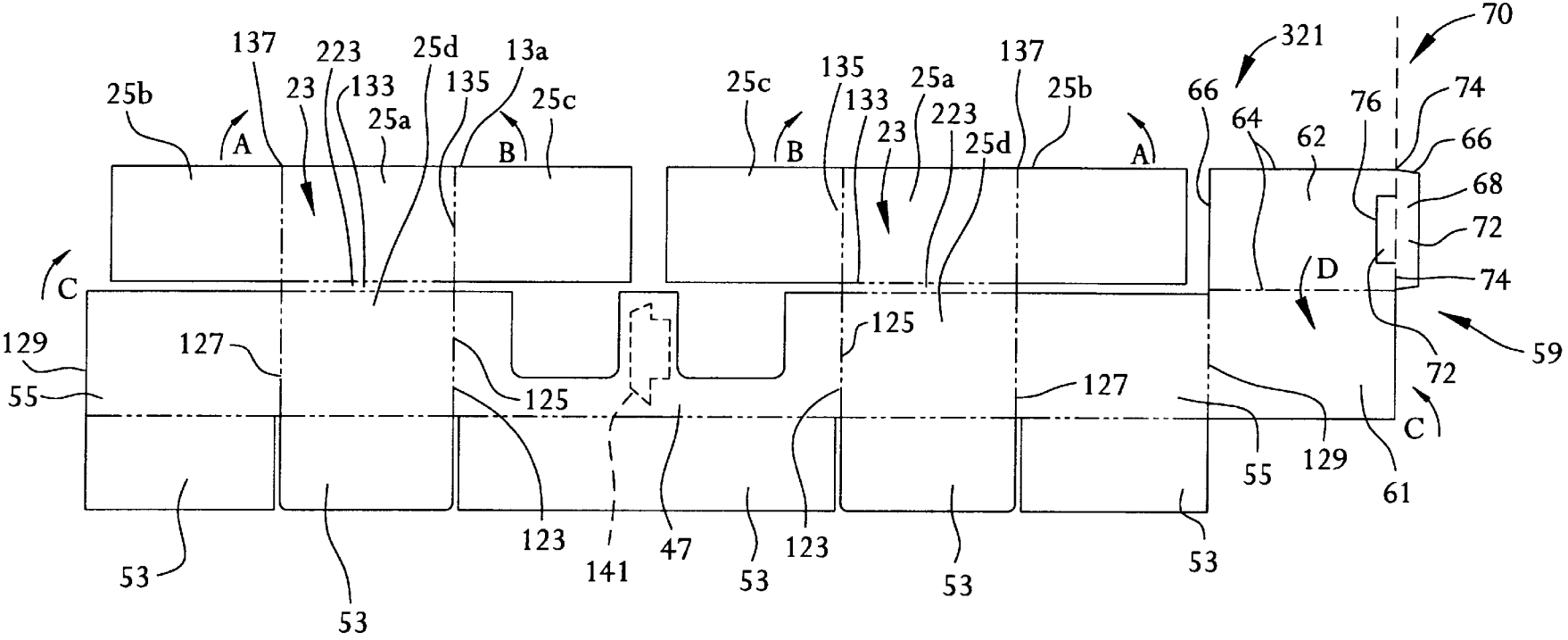
FIG. 7 is another embodiment of the present invention.

Another alternative embodiment is similar to the container 21 shown in FIG. 1, except that the projections 31 and notches 35 have been eliminated, as well as the handholds 29. A blank 321 for such alternative container is shown in FIG. 7. Such a projection-less and notch-less container is particularly suitable when the containers on a pallet are oriented such that upper boxes overlap two or more boxes in a next lower layer. The absence of projections generally eases placement of the containers in such "staggered" relationships and movement of the containers relative to each other. Blank 321 is similar to the blank 121 in die-cut sheet form shown in FIG. 5, except that openings 37 for handholds 29, and notches 39 and 57 have been eliminated. Otherwise, like reference numerals have been used to indicate similar structures.

In addition to the advantages apparent from the foregoing description, the present invention improves the container's strength, especially crushed in the vertical direction. A related advantage is that the contents of such containers are less likely to be damaged.

As a further advantage, the present invention allows containers to remain in registration with each other and resist being moved out of such registration. In other words, when adjacent containers have corresponding projections 31 and notches 33 inter-engaged, it is less likely that such containers will be inadvertently, horizontally displaced or knocked off the stack of underlying containers.

As yet another advantage, the containers according to the present invention are easy to move by means of handholds 29, and the containers of the invention minimize the amount of scrap that needs to be removed from the display floor when the containers are used directly off of pallets.

The invention having been disclosed in connection with the foregoing variations and examples, additional variations will be apparent to persons skilled in the art. The invention is not intended to be limited to the variations specifically mentioned, and accordingly, reference should be made to the appended claims rather than the foregoing discussion of preferred examples in order to access the scope of the invention in which exclusive rights are claimed.

What is claimed is:

1. A container comprising a plurality of panels positioned to form a bottom, front, back and opposing sides, the sides having a first edge and a second edge extending substantially horizontally, the sides comprising at least three side panels in substantially registered relationship with each other, at least one of the sides having a projection extending from the first edge and projection engaging means located on the second edge;

a vertically oriented partition located within the container to form at least two compartments therein; and, a pair of folded integral partition flaps having a pair of opposite transverse edges, one of said flaps being folded along an axis on one of said transverse edges to form first and second tabs extending on opposite sides of the axis in substantially opposite directions, the first and second tabs extending generally outwardly from planes coincident with the partition flaps.

2. The container of claim 1, wherein each of the sides includes a pair of the projections and a pair of the projection engaging means.

3. The container of claim 1, wherein the sides have at least four side panels, including a pair of inner panels adjacent to each other and a pair of outer panels, the first outer panel adjacent to one of the inner panels and the second outer panel adjacent to the other of the inner panels, the projection and the projection engaging means being located on at least one of the inner panels on each of the sides.

4. The container of claim 3, wherein the projection has a double-wall thickness formed by portions of the pair of inner panels which are in registered relationship with each other and which extend from the sides, and wherein the projection engaging means comprises a notch having a double-wall thickness defined by edges of the pair of inner panels in registered relationship with each other.

5. The container of claim 4, wherein the notch is further defined by longitudinally extending sidewalls, the sidewalls comprising portions of the outer panels.

6. The container of claim 4, wherein each of the sides includes a pair of the projections and a pair of the notches.

7. The container of claim 6, wherein the pair of projections is located on the first edge and the pair of notches is located on the second edge.

8. The container of claim 3, wherein the bottom, front, back and sides define a contained space, and wherein the four panels comprise an interior panel adjacent to the contained space and three panels exterior to the interior panel, the exterior panels having portions defining openings therein, the openings in substantial registration with each other to define hand-holds in the sides of the container, the interior panel having a portion in registration with the openings to prevent access to the contained space through the handholds.

9. The container of claim 1 for stacking with a second container, and wherein at least one of the projection and the projection engaging means engages the second container when the containers are stacked.

10. The container of claim 1 for stacking with a second container having opposing sidewalls, and wherein at least one of the projection and the projection engaging means engages at least one of the sidewalls of the second container when the containers are stacked in registration with each other.

11. The container of claim 1, wherein each of the panels substantially extends between the edges of the sides to increase the compressive strength of the sides.

12. The container of claim 1, further comprising a blank of corrugated board in which the panels are integrally formed, wherein the bottom, front, back and sides are formed by folding the blank of corrugated board.

13. The container of claim 1, wherein the surfaces of the side panels which face each other are in substantial contact with each other.

14. The container of claim 1, wherein the projection comprises an elongated tab.

15. A container comprising a plurality of panels positioned to form a bottom, front, back and opposing sides, the sides having a first edge and a second edge extending substantially horizontally, at least one of the sides having a projection extending from the first edge and projection engaging means located on the second edge;

a pair of folded integral partition flaps having a pair of opposite transverse edges, one of said flaps being folded along an axis on one of said transverse edges to form first and second tabs extending on opposite sides of the axis in substantially opposite directions, the first and second tabs extending generally outwardly from planes coincident with the partition flaps.

16. The container of claim 15, wherein the bottom, front, back and sides define a contained space having a height, and wherein the partition substantially, vertically spans the height of the contained space to strengthen the container.

17. The container of claim 16, wherein the partition comprises a pair of partition panels, wherein each of the side panels substantially extends between the edges of the sides, whereby the partition panels and the side panels comprise ten vertical walls to strengthen the container.

* * * * *

UNITED STATES PATENT AND TRADEMARK OFFICE

CERTIFICATE OF CORRECTION

PATENT NO. : 5,839,650

DATED : November 24, 1998

INVENTOR(S) : Phil B. Sheffer

It is certified that error appears in the above-indentified patent and that said Letters Patent is hereby corrected as shown below:

Column 13, Claim 15, line 18, after "edge;", insert the new paragraph --a vertically oriented partition located within the container to form at least two compartments therein; and,-- .

Signed and Sealed this

Eighteenth Day of May, 1999

*Attest:*

Q. TODD DICKINSON

*Attesting Officer*

*Acting Commissioner of Patents and Trademarks*